US010197301B2

(12) United States Patent
Nikaido et al.

(10) Patent No.: US 10,197,301 B2
(45) Date of Patent: Feb. 5, 2019

(54) HEAT SOURCE SYSTEM, AND CONTROL DEVICE AND CONTROL METHOD THEREFOR

(71) Applicant: MITSUBISHI HEAVY INDUSTRIES THERMAL SYSTEMS, LTD., Tokyo (JP)

(72) Inventors: Satoshi Nikaido, Tokyo (JP); Toshiaki Ouchi, Tokyo (JP); Minoru Matsuo, Tokyo (JP); Koki Tateishi, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 15/518,271

(22) PCT Filed: Oct. 16, 2015

(86) PCT No.: PCT/JP2015/079293
§ 371 (c)(1),
(2) Date: Apr. 11, 2017

(87) PCT Pub. No.: WO2016/076068
PCT Pub. Date: May 19, 2016

(65) Prior Publication Data

US 2017/0307247 A1 Oct. 26, 2017

(30) Foreign Application Priority Data

Nov. 12, 2014 (JP) ..... 2014-230033

(51) Int. Cl.
*F24F 11/89* (2018.01)
*F24F 140/50* (2018.01)
*F24F 11/32* (2018.01)

(52) U.S. Cl.
CPC ..... *F24F 11/89* (2018.01); *F24F 11/32* (2018.01); *F24F 2140/50* (2018.01)

(58) Field of Classification Search
CPC ..... F24F 11/89; F24F 11/02; F24F 2140/50; F24F 11/32; F25B 49/02; F25B 49/022
See application file for complete search history.

(56) References Cited

U.S. PATENT DOCUMENTS

2015/0252814 A1 9/2015 Nakahara et al.

FOREIGN PATENT DOCUMENTS

EP 2918934 A1 9/2015
JP 64-90939 A 4/1989
(Continued)

*Primary Examiner* — Emmanuel Duke
(74) *Attorney, Agent, or Firm* — Birch, Stewart, Kolasch & Birch, LLP

(57) ABSTRACT

The purpose of the present invention is to avoid frequent repetition of an increase/decrease stage caused by the inclusion, in a heat source system, of a machine the capacity of which has been degraded. A heat source system of the present invention is provided with a plurality of heat source machines. A higher-level control device (20) controls each of the heat source machines so that a heat medium delivery temperature, which is the temperature of a heat medium being supplied to an external load, will be a set temperature. The higher-level control device (20) is provided with a number-of-machines control unit (22), a degraded machine detection unit (24), and a priority ranking modification unit (25). The number-of-machines control unit (22) controls the number of heat source machines in accordance with operational priority ranking information in which each of the heat source machines and an operational priority ranking are associated together. The degraded machine detection unit (24) detects, as a capacity-degraded machine, a heat source machine that satisfies a predetermined capacity degradation condition, from among operating heat source machines. The
(Continued)

priority ranking modification unit (25), if a capacity-degraded machine has been detected, modifies to a lowest position the operational priority ranking of the capacity-degraded machine in the operational priority ranking information.

3 Claims, 5 Drawing Sheets

(56) References Cited

FOREIGN PATENT DOCUMENTS

| | | | | | |
|---|---|---|---|---|---|
| JP | 2000-18672 | A | | 1/2000 | |
| JP | 2010-243092 | A | | 10/2010 | |
| JP | 2011-58660 | A | | 3/2011 | |
| JP | 2011169533 | A | * | 9/2011 | |
| JP | 2013210149 | A | * | 10/2013 | ..... F24F 11/89 |
| WO | WO 2014/050195 | A1 | | 4/2014 | |

* cited by examiner

HEAT SOURCE SYSTEM, AND CONTROL DEVICE AND CONTROL METHOD THEREFOR

TECHNICAL FIELD

The present invention relates to a heat source system, and a control device and a control method therefor.

BACKGROUND ART

A heat source system provided with a plurality of heat source machines connected in parallel to each other is known (see, for example, PTL 1). In such a heat source system, generally, the operation of each of the heat source machines is performed so that the temperature of a heat medium delivered from a heat source machine side to an external load such as an air conditioner or a fan coil (hereinafter, referred to as a "heat medium delivery temperature") is a set temperature (for example, 7° C.) which is set in accordance with the demand of an external load side.

In such a heat source system, in a case where a heat source machine which is not capable of exhibiting a rated capacity due to a reason such as degradation over time (hereinafter, referred to as a "capacity-degraded machine") is included in operating heat source machines, there may be a concern of a water supply temperature greatly diverging from a set value.

Regarding such a problem, for example, PTL 1 discloses that a threshold is set with respect to a water supply temperature, and a forced increase stage is performed on a heat source machine in a stop state in a case of exceeding the threshold, to thereby prevent the water supply temperature from rising.

In addition, PTL 1 discloses that, in consideration of the possibility of a forced increase stage temperature set value for performing a forced increase stage on a heat source machine being lower than a normal decrease stage temperature set value, the decrease stage temperature set value is reset to a value obtained by subtracting a predetermined temperature from the forced increase stage temperature set value after the forced increase stage, to thereby prevent an increase/decrease stage of the heat source machine from being repeated.

CITATION LIST

Patent Literature

[PTL 1] Japanese Unexamined Patent Application Publication No. 2000-18672

SUMMARY OF INVENTION

Technical Problem

However, in a control method disclosed in PTL 1 stated above, a prompt decrease stage after the forced increase stage can be prevented from occurring, but there is a problem in that it is not possible to cope with the following repeated occurrence of the forced increase stage.

For example, when heat source machines other than a capacity-degraded machine is subject to a decrease stage process in a case where the forced increase stage occurs with a rise in water supply temperature, a load then drops and the decrease stage process occurs, a state where the capacity-degraded machine is included in operating heat source machines is maintained. In this state, when a load rises once again, the water supply temperature rises once again due to the influence of the capacity-degraded machine, and the forced increase stage occurs once again. The increase/decrease stage of the heat source machine is frequently repeated due to such a situation repeatedly occurring.

The present invention is contrived in view of such circumstances, and an object thereof is to provide a heat source system, and a control device and a control method therefor which are capable of avoiding the frequent repetition of an increase/decrease stage caused by a capacity-degraded machine being included in a heat source system.

Solution to Problem

According to a first aspect of the present invention, there is provided a control device for a heat source system, applied to the heat source system provided with a plurality of heat source machines, which controls the heat source machines so that a heat medium delivery temperature which is a temperature of a heat medium being supplied to an external load is a set temperature, the device including: number-of-machines control means for controlling the number of heat source machines in accordance with operational priority ranking information in which each of the heat source machines and an operational priority ranking are associated with each other; degraded machine detection means for detecting a heat source machine that satisfies a predetermined capacity degradation condition, as a capacity-degraded machine, from among the heat source machines in operation; and priority ranking modification means for modifying the operational priority ranking of the capacity-degraded machine in the operational priority ranking information to a lowest position in a case where the capacity-degraded machine is detected.

According to the control device for a heat source system of the first aspect, in a case where a capacity-degraded machine is detected, the operational priority ranking of the capacity-degraded machine is modified to a lowest position. Thereby, in a case where a decrease stage process performed by the number-of-machines control means occurs, it is possible to preferentially stop the capacity-degraded machine, and to start up heat source machines other than the capacity-degraded machine preferentially over the capacity-degraded machine in the increase stage process. Thereby, it is possible to reduce a chance of the capacity-degraded machine being operated insofar as possible. As a result, it is possible to avoid frequent repetition of an increase/decrease stage caused by a capacity-degraded machine being included in operating heat source machines.

The control device for a heat source system of the first aspect may further include: load distribution means for performing load distribution so as not to exceed an output enable upper limit of each of the heat source machines, using capacity information in which each of the heat source machines and the output enable upper limit are associated with each other; and capacity modification means for degrading the output enable upper limit of the capacity-degraded machine in a case where the capacity-degraded machine is detected.

According to the control device for a heat source system of the first aspect, it is possible to prevent a load equal to or greater than a capacity from being allocated to the capacity-degraded machine. As a result, it is possible to prevent the heat medium outlet temperature of the capacity-degraded machine from diverging from the heat medium outlet set temperature, and to prevent the heat medium delivery temperature from diverging from the set temperature.

The term "output enable upper limit" as used herein refers to a value which is set as the output enable maximum capacity of the heat source machine, and includes, for example, a rated capacity. In addition, the "output enable upper limit" may be an output enable maximum capacity, or may be a value which is determined on the basis of the rated capacity or the output enable maximum capacity.

In the control device for a heat source system of the first aspect, the number-of-machines control means may determine a necessity of an increase stage in accordance with a demand load and an increase stage threshold, and the device may further include increase stage threshold modification means for modifying the increase stage threshold in accordance with an output enable capacity of the capacity-degraded machine in a case where the capacity-degraded machine is detected.

According to the control device for a heat source system of the first aspect, since the increase stage threshold referenced for number-of-machines control is also modified in accordance with the output enable capacity of the capacity-degraded machine, it is possible to perform an increase stage process at an appropriate timing in accordance with the capacity of the current heat source system.

In the control device for a heat source system of the first aspect, the number-of-machines control means may determine a necessity of a decrease stage in accordance with a demand load and a decrease stage threshold, and the device may further include decrease stage threshold modification means for modifying the decrease stage threshold in accordance with the output enable capacity of the capacity-degraded machine in a case where the capacity-degraded machine is detected.

According to the control device for a heat source system of the first aspect, since the decrease stage threshold referenced for number-of-machines control is also modified in accordance with the output enable capacity of the capacity-degraded machine, it is possible to perform a decrease stage process at an appropriate timing in accordance with the capacity of the current heat source system.

According to a second aspect of the present invention, there is provided a control device for a heat source system, applied to the heat source system provided with a plurality of heat source machines, which controls the heat source machines so that a heat medium delivery temperature which is a temperature of a heat medium being supplied to an external load is a set temperature, the device including: load distribution means for performing load distribution so as not to exceed an output enable upper limit of each of the heat source machines, using capacity information in which each of the heat source machines and the output enable upper limit are associated with each other; degraded machine detection means for detecting a heat source machine that satisfies a predetermined capacity degradation condition, as a capacity-degraded machine, from among the heat source machines in operation; and capacity modification means for degrading the output enable upper limit of the capacity-degraded machine in the capacity information in a case where the capacity-degraded machine is detected.

According to the control device of the heat source system of the second aspect, in a case where a capacity-degraded machine is detected, the output enable upper limit of the capacity-degraded machine in the capacity information is degraded. Thereby, it is possible to avoid the allocation of a load equal to or greater than a capacity to the capacity-degraded machine. Thereby, it is possible to previously prevent the heat medium outlet temperature of the capacity-degraded machine from diverging from the heat medium outlet set temperature, and to prevent the heat medium delivery temperature from diverging from the set temperature. As a result, it is possible to previously prevent the increase/decrease stage of a heat source machine from being frequently repeated.

The control device for a heat source system of the second aspect may further include: number-of-machines control means for determining a necessity of an increase stage in accordance with a demand load and an increase stage threshold; and increase stage threshold modification means for modifying the increase stage threshold in accordance with an output enable capacity of the capacity-degraded machine in a case where the capacity-degraded machine is detected.

According to the control device of the heat source system of the second aspect, since the increase stage threshold referenced for number-of-machines control is also modified in accordance with the output enable capacity of the capacity-degraded machine, it is possible to perform an increase stage process at an appropriate timing in accordance with the capacity of the current heat source system.

The control device for a heat source system of the second aspect may further include: number-of-machines control means for determining a necessity of a decrease stage in accordance with a demand load and a decrease stage threshold; and decrease stage threshold modification means for modifying the decrease stage threshold in accordance with the output enable capacity of the capacity-degraded machine in a case where the capacity-degraded machine is detected.

According to the control device of the heat source system of the second aspect, since the decrease stage threshold referenced for number-of-machines control is also modified in accordance with the output enable capacity of the capacity-degraded machine, it is possible to perform a decrease stage process at an appropriate timing in accordance with the capacity of the current heat source system.

In the control device for a heat source system of the second aspect, the degraded machine detection means may determine that the capacity degradation condition is satisfied in a case where, in a steady state, a difference between a heat medium outlet temperature and a heat medium outlet set temperature of the heat source machine is equal to or greater than a predetermined threshold, and a current capacity is less than the output enable upper limit.

In the control device for a heat source system of the second aspect, the degraded machine detection means may determine that the capacity degradation condition is satisfied in a case where, in a steady state, a parameter relating to a predetermined component included in the heat source machine is a rated value, and a current capacity is less than the output enable upper limit.

In the control device for a heat source system of the second aspect, the degraded machine detection means may exclude a heat source machine which is in a state where capacity exhibition is restricted, from a determination target of the capacity-degraded machine.

For example, as in a heat source machine during demand control, a heat source machine which is in a state where capacity exhibition is restricted may operate at the output enable upper limit or less, and has the possibility to satisfy the capacity degradation condition. According to the control device for a heat source system, the heat source machine which is in a state where capacity exhibition is restricted is excluded from a determination target of a capacity-degraded machine, and thus it is possible to prevent the heat source machine which is in a state where capacity exhibition is restricted from being erroneously detected as a capacity-degraded machine.

The control device for a heat source system of the second aspect may further include: forced increase stage determination means for determining whether a condition of a predetermined forced increase stage is satisfied by the heat medium delivery temperature diverging from the set temperature; and forced increase stage means for performing a forced increase stage in a case where it is determined that the condition of a forced increase stage is satisfied.

According to the control device of the heat source system of the second aspect, in a case where the condition of a predetermined forced increase stage is satisfied by the heat medium delivery temperature diverging from the set temperature, the forced increase stage is performed on the heat source machine. Thereby, the heat medium delivery temperature can be rapidly brought close to the set temperature.

In the control device for a heat source system of the second aspect, the forced increase stage determination means may determine that the condition of a forced increase stage is satisfied in a case where, in a steady state, a state in which a difference between a heat medium delivery temperature and a set temperature or a proportional integration value of the difference between a heat medium delivery temperature and a set temperature is equal to or greater than a predetermined forced increase stage threshold continues for a predetermined period.

In the control device for a heat source system of the second aspect, the forced increase stage means may preferentially start up a heat source machine having a short time from startup to capacity exhibition, among the heat source machines of which operations are stopped.

According to the control device of the heat source system of the second aspect, in a case of the forced increase stage, a heat source machine having a short time from startup to capacity exhibition is preferentially started up, it is possible to shorten a time to bring the heat medium delivery temperature close to the set temperature.

In the control device for a heat source system of the second aspect, the forced increase stage means may preferentially start up a heat source machine having an output enable upper limit greater than a shortage of a demand load, among the heat source machines of which operations are stopped.

According to the control device of the heat source system of the second aspect, it is possible to reduce the number of heat source machines to be started up insofar as possible.

According to a third aspect of the present invention, there is provided a heat source system including the control device for a heat source system.

The heat source system of the third aspect may further include notification means for giving notice of detection of the capacity-degraded machine.

According to the heat source system of the third aspect, it is possible to notify a user that the capacity-degraded machine is detected.

According to fourth aspect of the present invention, there is provided a control method for a heat source system, applied to the heat source system provided with a plurality of heat source machines, in which the heat source machines are controlled so that a heat medium delivery temperature which is a temperature of a heat medium being supplied to an external load is a set temperature, the method including: a number-of-machines control process of controlling the number of heat source machines in accordance with operational priority ranking information in which each of the heat source machines and an operational priority ranking are associated with each other; a degraded machine detection process of detecting a heat source machine that satisfies a predetermined capacity degradation condition, as a capacity-degraded machine, from among the heat source machines in operation; and a priority ranking modification process of modifying the operational priority ranking of the capacity-degraded machine in the operational priority ranking information to a lowest position in a case where the capacity-degraded machine is detected.

According to a fifth aspect of the present invention, there is provided a control method for a heat source system, applied to the heat source system provided with a plurality of heat source machines, in which the heat source machines are controlled so that a heat medium delivery temperature which is a temperature of a heat medium being supplied to an external load is a set temperature, the method including: a load distribution process of performing load distribution so as not to exceed an output enable upper limit of each of the heat source machines, using capacity information in which each of the heat source machines and the output enable upper limit are associated with each other; a degraded machine detection process of detecting a heat source machine that satisfies a predetermined capacity degradation condition, as a capacity-degraded machine, from among the heat source machines in operation; and a capacity modification process of degrading the output enable upper limit of the capacity-degraded machine in the capacity information in a case where the capacity-degraded machine is detected.

Advantageous Effects of Invention

According to the present invention, an effect is exhibited in which it is possible to avoid frequent repetition of an increase/decrease stage caused by a capacity-degraded machine being included in a heat source system.

DESCRIPTION OF EMBODIMENTS

First Embodiment

Hereinafter, a heat source system according to a first embodiment of the present invention, and a control device and a control method therefor will be described with reference to the accompanying drawings.

Figure 1:
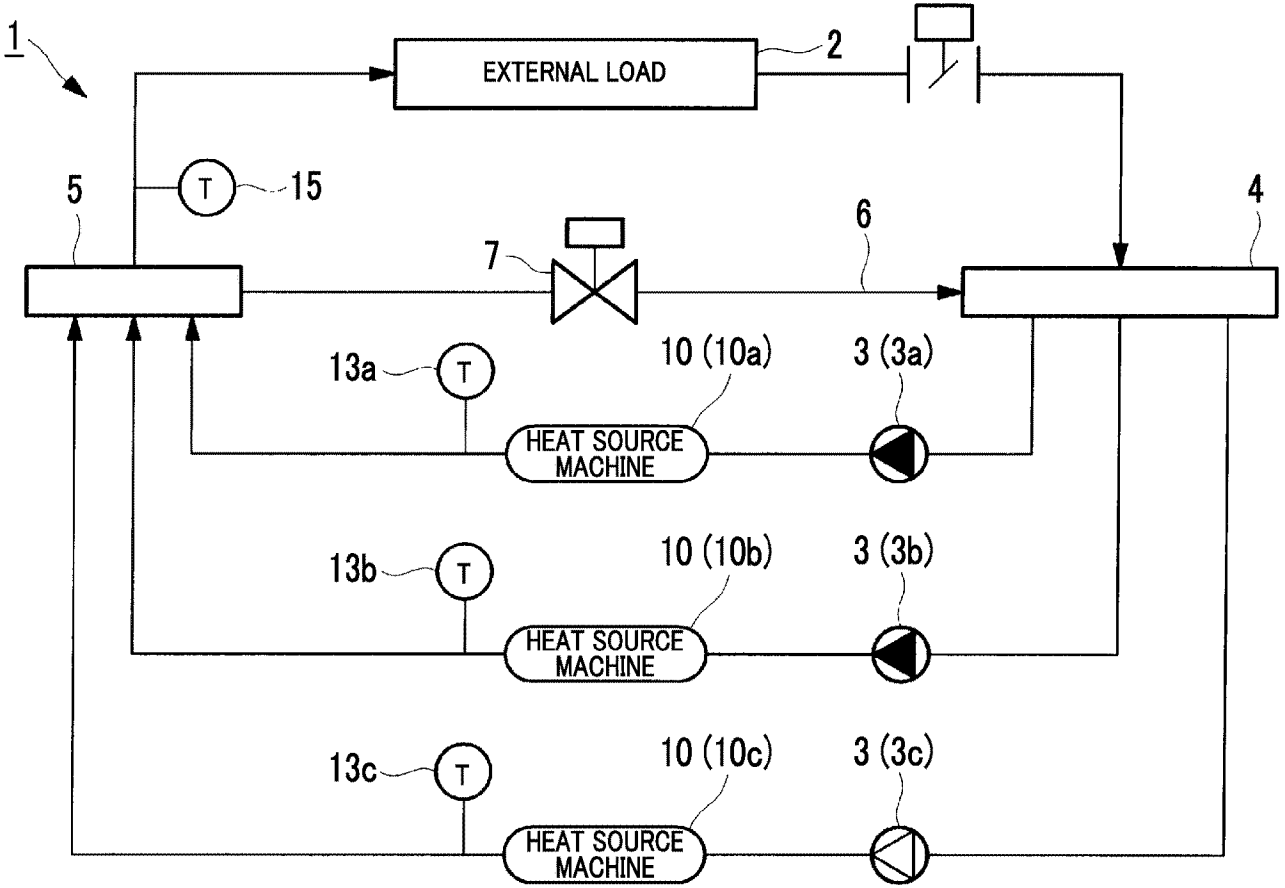
FIG. 1 is a diagram schematically illustrating a configuration of a heat source system according to a first embodiment of the present invention.

FIG. 1 is a diagram schematically illustrating a configuration of a heat source system according to the first embodiment of the present invention. A heat source system 1 includes a plurality of heat source machines 10 (10*a*, 10*b*, 10*c*)(hereinafter, the respective heat source machines are simply denoted by a sign "10" when the machines are not distinguished from each other, and the respective heat source machines are denoted by signs "10*a*", "10*b*" and the like when the machines are distinguished from each other; the same is true of other configurations) that heat or cool a heat medium (chilled water) which is supplied to an external load 2 such as, for example, an air conditioner, a water heater, or a plant facility. These heat source machines 10*a*, 10*b*, and 10*c* are connected in parallel to the external load 2. In addition, in FIG. 1, a case is illustrated in which three heat source machines 10*a*, 10*b*, and 10*c* are installed, but the number of heat source machines 10 installed can be arbitrarily determined.

The heat source machines 10 may have the same type and the same capacity, and may have different types or different capacities mixed therein. An example of the heat source machine includes a turbo chiller, an absorption chiller or the like.

Pumps 3 (3*a*, 3*b*, 3*c*) that pressure-feed a heat medium are installed on the upstream sides of each of the heat source machines 10*a*, 10*b*, and 10*c* when seen from a flow of the heat medium, respectively. A heat medium from a return header 4 is sent to each of the heat source machines 10*a*, 10*b*, and 10*c* by these pumps 3*a*, 3*b*, and 3*c*. Each of the pumps 3*a*, 3*b*, and 3*c* is configured to be driven by an inverter motor (not shown), and thereby, variable flow rate control is performed thereon by making the number of rotations variable.

Cooled or heated heat mediums are collected in a supply header 5 in each of the heat source machines 10*a*, 10*b*, and 10*c*. The heat mediums collected in the supply header 5 are supplied to the external load 2. The heat medium which is supplied to an air conditioner or the like by the external load 2 and is heated or cooled is sent to the return header 4. The heat medium is branched in the return header 4, and is sent to each of the heat source machines 10*a*, 10*b*, and 10*c* again.

A bypass piping 6 is provided between the supply header 5 and the return header 4. The bypass piping 6 is provided with a bypass valve 7 for adjusting a bypass flow rate.

The heat medium outlet sides of the respective heat source machines 10*a*, 10*b*, and 10*c* are provided with temperature sensors 13*a*, 13*b*, and 13*c* that measure a heat medium outlet temperature, respectively. In addition, the downstream side of the supply header 5 in a flow of the heat medium is provided with a temperature sensor 15 for measures the heat medium delivery temperature which is the temperature of the heat medium delivered to the external load 2.

Figure 2:
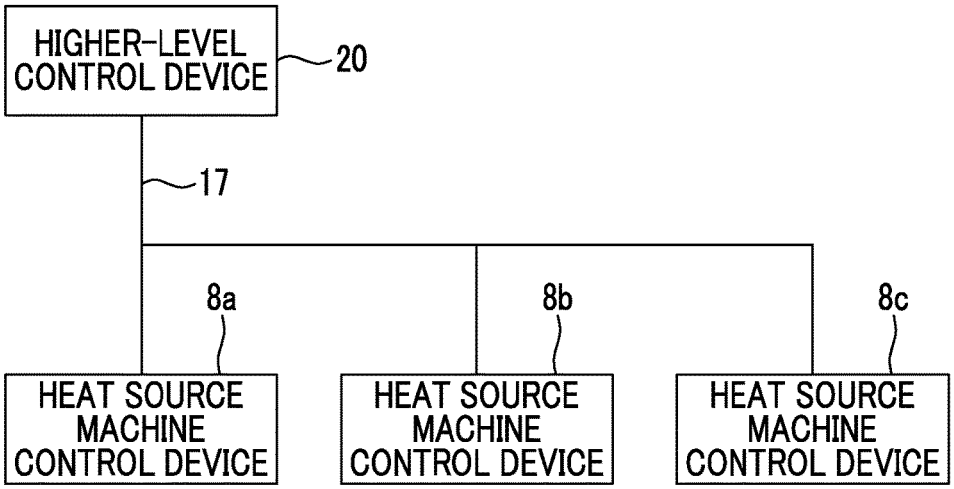
FIG. 2 is a diagram schematically illustrating a configuration of a control system of the heat source system according to the first embodiment of the present invention.

FIG. 2 is a diagram schematically illustrating a configuration of a control system of the heat source system 1 shown in FIG. 1. As shown in FIG. 2, heat source machine control devices 8*a*, 8*b*, and 8*c* which are control devices of the respective heat source machines 10*a*, 10*b*, and 10*c* are connected to a higher-level control device 20 through a communication medium 17, and are configured to be capable of bidirectional communication.

The higher-level control device 20 is a control device that controls the entire heat source system, and controls the heat source system 1 so that a heat medium delivery temperature becomes a set temperature determined by a demand for the external load 2. Specifically, the higher-level control device 20 performs outlet temperature control of the heat source machines 10*a*, 10*b*, and 10*c*, operation number-of-machines control of the heat source machine 10 based on the demand load of the external load 2, load distribution control for allocating a load to the operating heat source machine 10, flow rate control of each of the pumps 3*a*, 3*b*, and 3*c*, valve opening control of the bypass valve 7 based on a differential pressure between the supply header 5 and the return header 4, and the like. In addition, in order to realize such control, a configuration is used in which the heat medium outlet temperature and the heat medium delivery temperature of each of the heat source machines 10*a*, 10*b*, and 10*c* measured by each of the temperature sensors 13*a* to 13*c* are input to the higher-level control device 20. These pieces of information may be input to the higher-level control device 20 through the heat source machine control device 8*a* to 8*c*, and may be directly input to the higher-level control device 20.

The higher-level control device 20 and the heat source machine control devices 8*a*, 8*b*, and 8*c* are, for example, computers, and include a central processing unit (CPU), a main storage device such as a random access memory (RAM), an auxiliary storage device, a communication device that exchanges information by performing communication with an external device, and the like. The auxiliary storage device is a computer readable recording medium, and is, for example, a magnetic disc, a magneto-optic disc, a CD-ROM, a DVD-ROM, a semiconductor memory, or the like. This auxiliary storage device has various programs stored therein, and has various processes realized therein by causing the CPU to read out a program from the auxiliary storage device to the main storage device and to execute the program.

Figure 3:
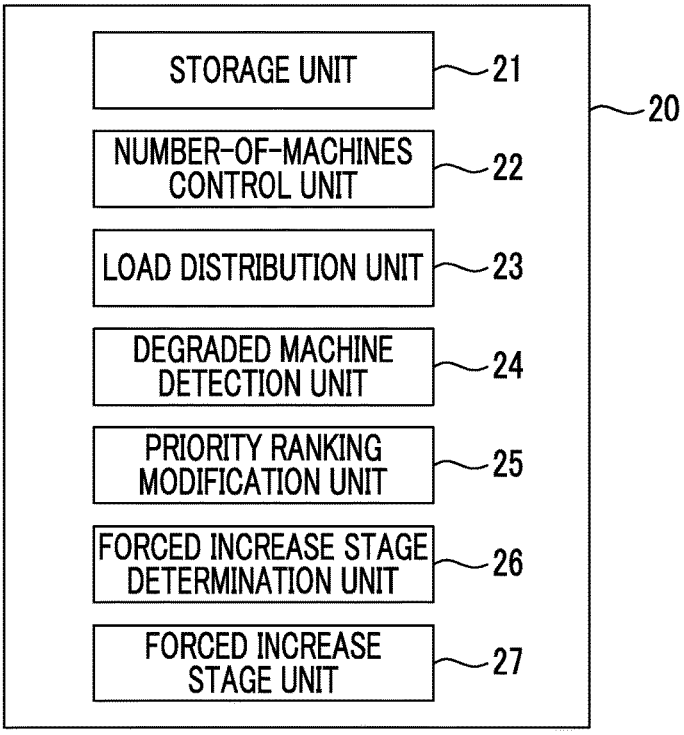
FIG. 3 is a functional block diagram illustrating a portion of functions included in a higher-level control device according to the first embodiment of the present invention.

FIG. 3 is a functional block diagram illustrating a portion of functions included in the higher-level control device 20. As shown in FIG. 3, the higher-level control device 20 includes a storage unit 21, a number-of-machines control unit 22, a load distribution unit 23, a degraded machine detection unit 24, a priority ranking modification unit 25, a forced increase stage determination unit 26, and a forced increase stage unit 27.

An operational priority ranking table (operational priority ranking information) in which an operational priority ranking relating to each of the heat source machines 10*a*, 10*b*, and 10*c* is set, a capacity table (capacity information) in which an output enable upper limit relating to each of the heat source machines 10*a*, 10*b*, and 10*c* is set, an increase stage threshold serving as a reference when an increase stage process is performed, a decrease stage threshold serving as a reference when a decrease stage process is performed, and the like are stored in the storage unit 21. Here, the operational priority ranking table and the like are rewritable.

The number-of-machines control unit 22 controls the number of heat source machines 10. For example, the number-of-machines control unit 22 compares the increase stage threshold and a demand load which are stored in the storage unit 21, and performs an increase stage process of starting up a stopping heat source machine 10 in a case where the demand load exceeds the increase stage threshold. In addition, the number-of-machines control unit 22 compares the decrease stage threshold and the demand load which are stored in the storage unit 21, and performs a decrease stage process of an operating heat source machine 10 in a stop state in a case where the demand load falls below the decrease stage threshold. In addition, during the increase stage process and the decrease stage process, a heat source machine 10 to be started up and a heat source machine 10 to be stopped are determined in accordance with the operational priority ranking table stored in the storage unit 21.

The load distribution unit 23 refers to the capacity table stored in the storage unit 21, and distributes a load so as not to exceed the output enable upper limit of each of the heat source machines 10*a*, 10*b*, and 10*c*. For example, in a case where the heat source machines 10*a* to 10*c* have the same type and the same capacity, a load is allocated by equal distribution. In addition, in a case where heat source machines 10 having different capacities or different types are mixed, the load distribution unit 23 predetermines, for example, information in an optimum load ratio range in which the coefficient of performance (COP) is set to be equal to or greater than a predetermined value in association with each of the heat source machines 10*a*, 10*b*, and 10*c*, and distributes a load so that the load ratio of each of the heat source machines 10*a*, 10*b*, and 10*c* is set to be in each optimum load ratio range. In this manner, load distribution considering the coefficient of performance is performed, and thus energy saving can be achieved.

The degraded machine detection unit 24 detects a heat source machine 10 that satisfies a predetermined capacity degradation condition, as a capacity-degraded machine, from among operating heat source machines 10. For example, in a case where a difference between the heat medium outlet temperature and the heat medium outlet set temperature of an operating heat source machine 10 is equal to or greater than a predetermined threshold and the current capacity is less than the output enable upper limit, the degraded machine detection unit 24 determines that the capacity degradation condition is satisfied, and detects the heat source machine 10 as a capacity-degraded machine.

Here, during heat medium cooling, it is not particularly necessary to be regarded as a problem in a case where the heat medium outlet temperature is lower than the heat medium outlet set temperature, and during heat medium heating, it is not necessary to be regarded as a problem in a case where the heat medium outlet temperature is higher than the heat medium outlet set temperature. Therefore, it may be determined whether the heat medium outlet temperature is a threshold or more higher than the heat medium outlet set temperature during heat medium cooling, or whether heat medium outlet temperature is a predetermined value or more lower than the heat medium outlet set temperature during refrigerant heating.

The capacity degradation condition is represented by expressions as follows.

[Capacity Degradation Condition]

Heat medium outlet temperature−heat medium outlet set temperature≥threshold (during heat medium cooling)

Heat medium outlet set temperature−heat medium outlet temperature≥threshold (during heat medium heating), and Current capacity<output enable upper limit In a case where a heat source machine 10 that satisfies the condition is present, the degraded machine detection unit 24 detects the heat source machine 10 as a capacity-degraded machine.

As in a heat source machine 10 during demand control, a heat source machine 10 which is in a state where capacity exhibition is restricted may operate at the output enable upper limit or less, and has the possibility to satisfy the capacity degradation condition. Therefore, the heat source machine 10 which is in a state where capacity exhibition is restricted is excluded from the determination target of a capacity-degraded machine. Thereby, it is possible to prevent the heat source machine (for example, heat source machine during demand control) 10 which is in a state where capacity exhibition is restricted from being erroneously detected as a capacity-degraded machine.

In addition, the capacity degradation condition is not limited to the example. For example, in a case where various parameters (such as, for example, evaporator pressure, compressor vane opening, or compressor rotation number in a case of a turbo chiller) relating to predetermined components included in the heat source machine 10 are rated values, and the current capacity is less than the output enable upper limit, it may be determined that the capacity degradation condition is satisfied.

In a case where a capacity-degraded machine is detected by the degraded machine detection unit 24, the priority ranking modification unit 25 modifies the operational priority ranking of the capacity-degraded machine in the operational priority ranking table stored in the storage unit 21 to a lowest position.

The forced increase stage determination unit 26 determines whether a predetermined forced increase stage condition is satisfied by the heat medium delivery temperature diverging from a set temperature. Specifically, in a case where a state in which a difference between the heat medium delivery temperature and the set temperature is equal to or greater than the forced increase stage threshold continues for a predetermined period in a steady state, the forced increase stage determination unit 26 determines that the forced increase stage condition is satisfied.

Here, during heat medium cooling, it is not particularly necessary to perform an increase stage in a case where the heat medium delivery temperature is lower than the set temperature, and during heat medium heating, it is not particularly necessary to perform an increase stage in a case where the heat medium delivery temperature is higher than the set temperature. Therefore, it may be determined whether the heat medium delivery temperature is the forced increase stage threshold or more higher than the set temperature during heat medium cooling, or whether the heat medium delivery temperature is the forced increase stage threshold or more lower than the set temperature during refrigerant heating.

The forced increase stage condition is represented by expressions as follows.

[Forced Increase Stage Condition]

The state of heat medium delivery temperature−set temperature≥forced increase stage threshold (during heat medium cooling) continues for a predetermined period The state of set temperature−heat medium delivery temperature≥forced increase stage threshold (during heat medium heating) continues for a predetermined period Meanwhile, the forced increase stage condition is not limited to the example. For example, a proportional integration value between the heat medium delivery temperature and the set temperature may be used instead of a difference between the heat medium delivery temperature and the set temperature.

In a case where it is determined by the forced increase stage determination unit 26 that the forced increase stage condition is satisfied, the forced increase stage unit 27 performs a forced increase stage. Here, a heat source machine 10 to be started up in accordance with the operational priority ranking table stored in the storage unit 21 is not selected in a case of the forced increase stage, and a heat source machine 10 to be started up on the basis of another reference may be selected. For example, in a case of the forced increase stage, since the heat medium delivery temperature has already diverged from the set temperature, the heat source machine 10 is started up as soon as possible, and thus a heat medium water supply temperature is required to be brought close to the set temperature. Therefore, from this viewpoint, for example, a type (for example, turbo chiller) having a short time from startup to capacity exhibition may be preferentially started up.

In addition, from the viewpoint of covering a shortage of the demand load with as small a number of heat source machines 10 as possible, rather than the viewpoint of the speed of startup, a heat source machine 10 having an output enable upper limit greater than a shortage of the demand load may be preferentially started up.

Figure 4:
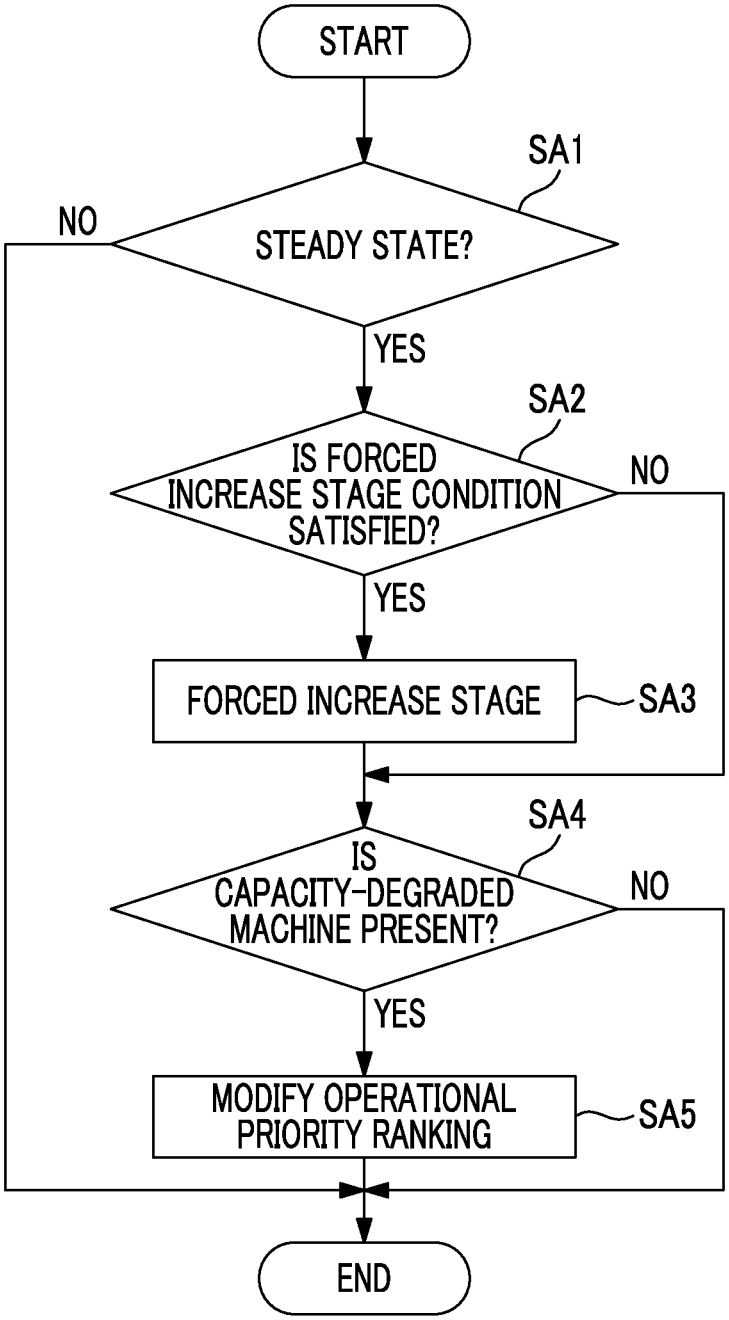
FIG. 4 is a flow diagram illustrating a procedure of a control method for the heat source system according to the first embodiment of the present invention.

Next, a control method for a heat source system executed by the higher-level control device 20 according to the present embodiment shown in FIG. 3 will be described with reference to FIG. 4. FIG. 4 is a flow diagram illustrating a procedure of a control method for a heat source system according to the present embodiment. The higher-level control device 20 repeatedly performs processes shown in FIG. 4 at a constant time interval. Meanwhile, the following processes may be performed concurrently with, for example, number-of-machines control performed by the number-of-machines control unit 22 or load distribution control performed by the load distribution unit 23.

First; it is determined whether being in a steady state (step SA1). This is because there is the possibility of erroneous detection being performed due to the state of the heat medium delivery temperature or the like not being stable in a case of being in a transitory state. Whether being in a steady state is determined, for example, using a determination criterion of whether a certain period of time has elapsed from the previous heat source machine startup or stop, whether a predetermined period has elapsed after the heat medium delivery temperature has reached the vicinity of the set temperature, or the like.

As a result, in a case where it is determined not to be in a steady state ("NO" in step SA1), the process is terminated. On the other hand, in a case where it is determined to be in a steady state ("YES" in step SA1), it is determined whether the forced increase stage condition is satisfied (forced increase stage determination unit: step SA2). As a result, in a case where it is determined that the forced increase stage condition is not satisfied ("NO" in step SA2), the process proceeds to step SA4. On the other hand, in a case where it is determined that the forced increase stage condition is satisfied ("YES" in step SA2), the forced increase stage is performed (forced increase stage unit: step SA3). Subsequently, a capacity-degraded machine is detected (degraded machine detection unit: step SA4). As a result, in a case where a capacity-degraded machine is present ("YES" in step SA4), the priority ranking of the capacity-degraded machine in the operational priority ranking table stored in the storage unit 21 is modified to a lowest position (priority ranking modification unit: step SA5), the process is terminated. On the other hand, in a case where a capacity-degraded machine is not present ("NO" in step SA4), the operational priority ranking table is not modified, and the process is terminated.

As described above, according to the heat source system 1 of the present embodiment and the control device and the control method therefor, in a case where a difference between the heat medium delivery temperature and the set temperature to the external load 2 is equal to or greater than the forced increase stage threshold, the forced increase stage is performed on the heat source machine 10, and in a case where a capacity-degraded machine is present, the operational priority ranking of the capacity-degraded machine is modified to a lowest position. Thereby, in a case where the decrease stage process performed by the number-of-machines control unit occurs, it is possible to preferentially stop the capacity-degraded machine, and to start up heat source machines 10 other than the capacity-degraded machine preferentially over the capacity-degraded machine in the increase stage process. Thereby, it is possible to reduce a chance of the capacity-degraded machine being operated insofar as possible. As a result, it is possible to avoid frequent repetition of an increase/decrease stage caused by a capacity-degraded machine being included in operating heat source machines 10.

In the flow illustrated in FIG. 4, a capacity-degraded machine is detected every time regardless of the presence or absence of the forced increase stage, but a capacity-degraded machine may be detected only in a case where the forced increase stage is performed. In this manner, it is possible to lower a frequency at which a process of detecting a capacity-degraded machine, and to achieve a reduction in processing load.

In the present embodiment, in a case where a capacity-degraded machine is detected, another heat source machine 10 and the capacity-degraded machine may be replaced with each other. Thereby, in a case where a capacity-degraded machine is detected, it is possible to early stop the operation of the capacity-degraded machine, and to realize a stable operation performed by a sound heat source machine 10.

Second Embodiment

Next, a heat source system according to a second embodiment of the present invention, and a control device and a control method therefor will be described. Hereinafter, common points with respect to those in the first embodiment described above are not described, and differences therefrom will be mainly described.

Figure 5:
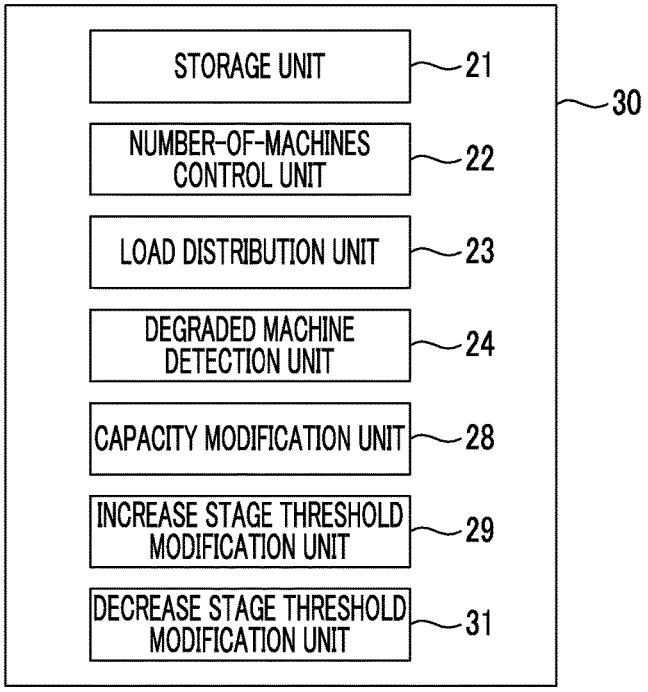
FIG. 5 is a functional block illustrating a portion of functions included in a higher-level control device according to a second embodiment of the present invention.

FIG. 5 shows a functional block diagram of a higher-level control device 30 of a heat source system according to the present embodiment. As shown in FIG. 5, the higher-level control device 30 includes a storage unit 21, a number-of-machines control unit 22, a load distribution unit 23, a degraded machine detection unit 24, a capacity modification unit 28, an increase stage threshold modification unit 29, and a decrease stage threshold modification unit 31.

The storage unit 21, the number-of-machines control unit 22, the load distribution unit 23, and the degraded machine detection unit 24 are the same as those in the first embodiment described above, and thus the description thereof will not be given.

In a case where a capacity-degraded machine is detected by the degraded machine detection unit 24, the capacity modification unit 28 lowers the output enable upper limit of the capacity-degraded machine in the capacity table stored in the storage unit 21. For example, a specified amount determined in advance and the output enable upper limit may be degraded, and the output enable upper limit of the capacity table may be modified to the current output enable maximum capacity in a case where the output enable maximum capacity of the capacity-degraded machine is known.

In a case where a capacity-degraded machine is detected, the increase stage threshold modification unit 29 modifies the increase stage threshold stored in the storage unit 21 in accordance with the output enable maximum capacity of the capacity-degraded machine. For example, the output enable maximum capacity $Q_i'$ of the capacity-degraded machine and the current increase stage threshold $Q_{ui}$ are compared with each other, and the smaller one is selected as the increase stage threshold of the capacity-degraded machine. Thereby, the increase stage threshold XU of the heat source system with respect to a facility load when n heat source machines operate in a state where capacity-degraded machines are mixed is represented by the following Expression (1). Meanwhile, regarding the increase stage thresholds of heat source machines other than the capacity-degraded machines, in other words, heat source machines capable of exhibiting a rated capacity, the current increase stage threshold $Q_{ui}$ is maintained.

$$XU(n) = \sum_{i=1}^{n} \{\min(Q'_{ui}, Q_{ui})\} \tag{1}$$

In a case where a capacity-degraded machine is detected, the decrease stage threshold modification unit 31 modifies the decrease stage threshold stored in the storage unit 21 in accordance with the output enable maximum capacity of the capacity-degraded machine. For example, the decrease stage threshold $Q_{di}'$ of the capacity-degraded machine is determined using the output enable maximum capacity $Q_i'$ of the capacity-degraded machine. Specifically, as shown in the following Expression (2), a value obtained by subtracting an insensitive object α from the output enable maximum capacity $Q_i'$ of the capacity-degraded machine is set to the decrease stage threshold $Q_{di}'$ of the capacity-degraded machine.

$$Q_{di}'=Q_i'-\alpha \tag{2}$$

Next, the decrease stage threshold $Q_{di}'$ of the capacity-degraded machine and the decrease stage threshold $Q_{di}$ of the current heat source machine are compared with each other, and the smaller one is set to the decrease stage threshold of the capacity-degraded machine. Thereby, the decrease stage threshold XD of the heat source system with respect to a facility load when n heat source machines operate in a state where capacity-degraded machines are mixed is represented by the following Expression (3). Meanwhile, regarding the decrease stage thresholds of heat source machines other than the capacity-degraded machines, in other words, heat source machines capable of exhibiting a rated capacity, the current decrease stage threshold $Q_{di}$ is maintained.

Figure 6:
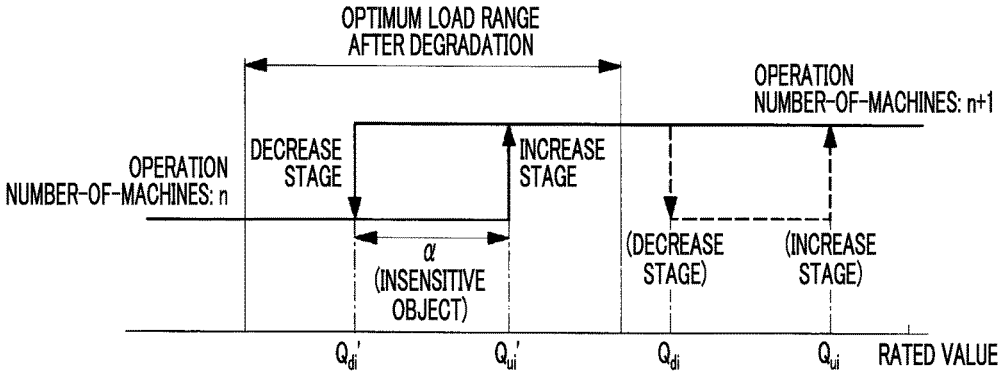
FIG. 6 is a diagram illustrating an increase stage threshold and a decrease stage threshold after being modified by an increase stage threshold modification unit and a decrease stage threshold modification unit.

Thereby, for example, as shown in FIG. 6, the increase stage threshold $Q_{ui}'$ and the decrease stage threshold $Q_{di}'$ of the capacity-degraded machine are shifted toward a decrease in accordance with the maximum capacity.

$$XD(n) = \sum_{i=1}^{n} \{\min(Q'_{di}, Q_{di})\} \tag{3}$$

In addition, the decrease stage threshold modification unit 31 compares the increase stage threshold XU(n−1) of the heat source system during the operation of n−1 machines considering the output enable maximum capacity of the capacity-degraded machine with the decrease stage threshold XD(n) of the heat source system during the operation of n machines considering the output enable maximum capacity of the capacity-degraded machine, and may further adjust the decrease stage threshold XD(n) so that the decrease stage threshold XD(n) is set to be equal to or less than the increase stage threshold XU(n−1) in a case where the decrease stage threshold XD(n) is equal to or greater than the increase stage threshold XU(n−1). Thereby, the decrease stage can be performed on the capacity-degraded machine without applying a load equal to or greater than the maximum capacity to the capacity-degraded machine.

Figure 7:
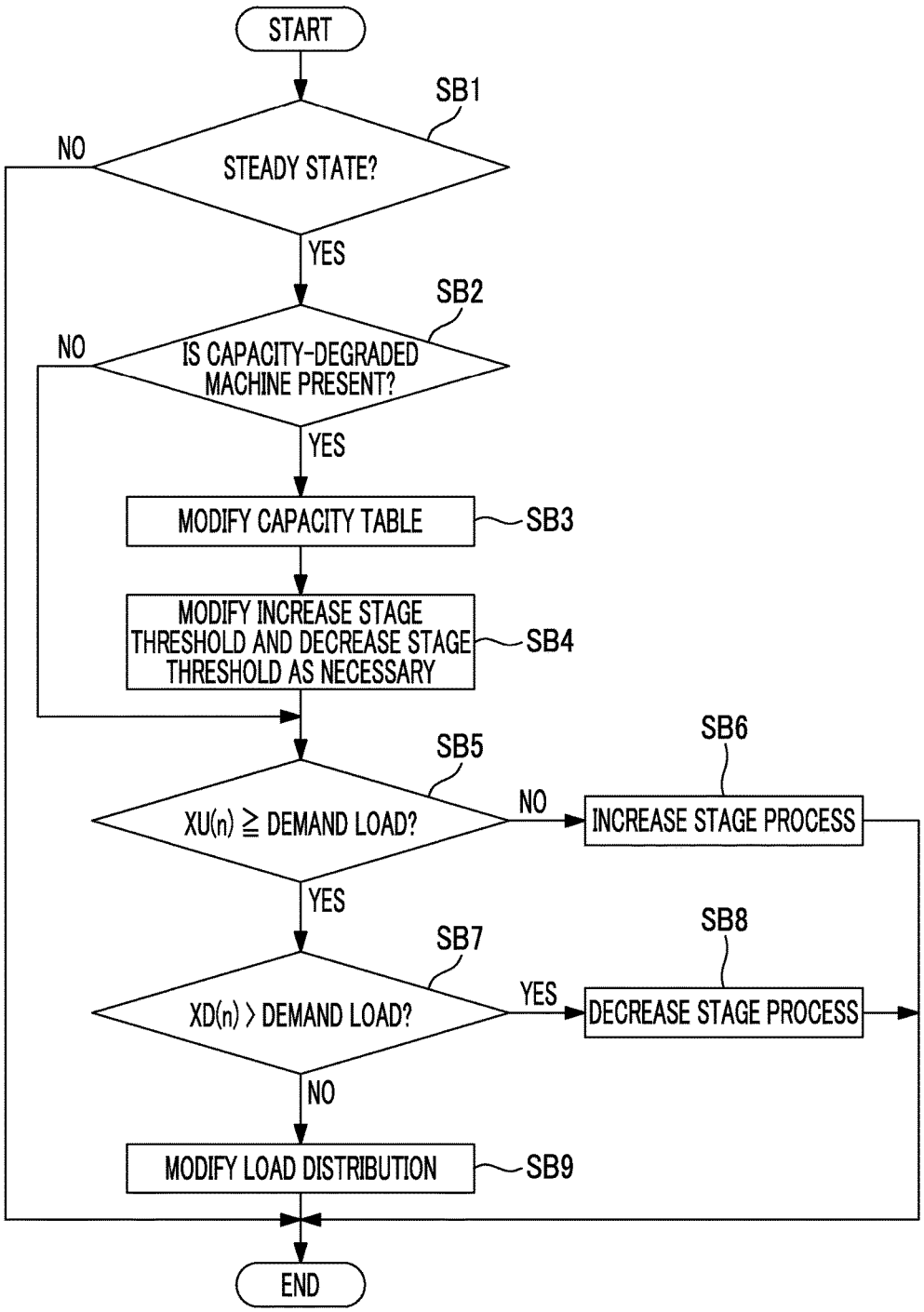
FIG. 7 is a flow diagram illustrating a procedure a control method for a heat source system according to the second embodiment of the present invention.

Next, a control method for a heat source system executed by the higher-level control device 30 according to the present embodiment will be described with reference to FIG. 7. FIG. 7 is a flow diagram illustrating a procedure of a control method for a heat source system executed by the higher-level control device 30. The higher-level control device 30 repeatedly performs processes shown in FIG. 7 at a constant time interval.

First, it is determined whether being in a steady state (step SB1). As a result, in a case where it is determined not to be in a steady state ("NO" in step SB1), the process is terminated. On the other hand, in a case where it is determined to be in a steady state ("YES" in step SB1), a capacity-degraded machine is detected (degraded machine detection unit: step SB2). As a result, in a case where a capacity-degraded machine is not present ("NO" in step SB2), the process proceeds to step SB5. On the other hand, in a case where a capacity-degraded machine is present ("YES" in step SB2), the output enable upper limit of the capacity-degraded machine in the capacity table stored in the storage unit 21 is modified (capacity modification unit: step SB3). Subsequently, the increase stage threshold and the decrease stage threshold which are stored in the storage unit 21 are modified as necessary (increase stage threshold modification unit and decrease stage threshold modification unit: step S34).

Next, the current demand load and the increase stage threshold XU(n) of the current heat source system are compared with each other, and it is determined whether the current demand load is equal to or less than the increase stage threshold XU(n) of the current heat source system, in other words, whether the current demand load can be satisfied by the current operating heat source machine (number-of-machines control unit: step SB5). As a result, in a case where the current demand load is larger than the increase stage threshold XU(n) of the current heat source system ("NO" in step SB5), the increase stage is performed on a heat source machine (number-of-machines control unit: step SB6).

On the other hand, in a case where the current demand load is equal to or less than the increase stage threshold XU(n) of the current heat source system ("YES" in step SB5), the current demand load and the decrease stage threshold XD(n) of the current heat source system are compared with each other, and it is determined whether the current demand load is less than the decrease stage threshold XD(n) of the current heat source system, in other words, whether the current demand load can be satisfied even in a case where the decrease stage is performed on a heat source machine having a lowest priority ranking in operating heat source machines (number-of-machines control unit: step SB7). As a result, in a case where the current demand load is less than the decrease stage threshold XD(n) of the current heat source system ("YES" in step SB7), the decrease stage is performed on a heat source machine (number-of-machines control unit: step SB8).

On the other hand, in a case where the current demand load is equal to or greater than the decrease stage threshold XD(n) of the current heat source system ("NO" in step SB7), the load distribution of the current operating heat source machine is modified (load distribution unit: step SB9). Specifically, the load distribution ratio of capacity-degraded machines is degraded, and the load distribution ratio of heat source machines having remaining power in capacity is raised, to thereby satisfy a demand load. The modification of the load ratio is performed by raising or lowering the heat medium outlet set temperature, or increasing or decreasing a heat medium flow rate.

As described above, according to the heat source system of the present embodiment, and the control device and the control method therefor, in a case where a capacity-degraded machine is present, the output enable upper limit of the capacity-degraded machine is modified in accordance with the current output enable capacity. Thereby, it is possible to avoid the allocation of a load equal to or greater than a capacity to the capacity-degraded machine. Thereby, it is possible to previously prevent the heat medium outlet temperature of the capacity-degraded machine from diverging from the heat medium outlet set temperature, and to prevent the heat medium delivery temperature from diverging from the set temperature. As a result, it is possible to previously prevent the increase/decrease stage of a heat source machine from being frequently repeated.

Since the increase stage threshold and the decrease stage threshold which are referenced for number-of-machines control are also appropriately modified in accordance with the output enable maximum capacity of the capacity-degraded machine, it is possible to perform an increase stage process and a decrease stage process at an appropriate timing in accordance with the capacity of the current heat source system, and to prevent the load of a capacity-degraded machine from exceeding the maximum capacity.

The present invention is not limited to only the above-described embodiments, and various modifications can be made without departing from the scope of the present invention.

For example, the first embodiment and the second embodiment described above may be partially combined with each other. For example, in the first embodiment, the operation of a capacity-degraded machine is continuously performed even after the capacity-degraded machine is detected, and the operation of the capacity-degraded machine is initially stopped when the decrease stage process occurs. Consequently, in a period until a capacity-degraded machine is detected and then the operation of the capacity-degraded machine is stopped, as in the second embodiment, the output enable upper limit of the capacity-degraded machine in the capacity table stored in the storage unit 21 is modified, the increase stage threshold and the decrease stage threshold are appropriately modified, and thus the load distribution considering a degradation in the capacity of the capacity-degraded machine and the increase stage and decrease stage processes may be performed.

In addition, for example, in a case where a capacity-degraded machine is detected, the heat source system according to each of the embodiments may include a notification unit that gives notice of the detection of the capacity-degraded machine. A specific example of the notification unit includes a warning device that acoustically transmits detection, a display that visually transmits detection, or the like, by way of example.

REFERENCE SIGNS LIST

1: heat source system
2: external load
3: pump
4: return header
5: supply header
10 (10*a* to 10*c*): heat source machine
13*a* to 13*c*, 15: temperature sensor
20, 30: higher-level control device
8*a* to 8*c*: heat source machine control device
21: storage unit
22: number-of-machines control unit
23: load distribution unit
24: degraded machine detection unit
25: priority ranking modification unit
26: forced increase stage determination unit
27: forced increase stage unit
28: capacity modification unit
29: increase stage threshold modification unit
31: decrease stage threshold modification unit

The invention claimed is:

1. A control device for a heat source system, applied to the heat source system provided with a plurality of heat source machines, which controls the heat source machines so that a heat medium delivery temperature which is a temperature of a heat medium being supplied to an external load is a set temperature, the device comprising:

load distribution means for performing load distribution so as not to exceed an output enable upper limit of each of the heat source machines, using capacity information in which each of the heat source machines and the output enable upper limit are associated with each other;

degraded machine detection means for detecting a heat source machine that satisfies a predetermined capacity degradation condition, as a capacity-degraded machine, from among the heat source machines in operation; and capacity modification means for degrading the output enable upper limit of the capacity-degraded machine in the capacity information in a case where the capacity-degraded machine is detected.

2. The control device for a heat source system according to claim 1, further comprising:

number-of-machines control means for determining a necessity of an increase stage in accordance with a demand load and an increase stage threshold; and increase stage threshold modification means for modifying the increase stage threshold in accordance with an output enable capacity of the capacity-degraded machine in a case where the capacity-degraded machine is detected.

3. The control device for a heat source system according to claim 1, further comprising:

number-of-machines control means for determining a necessity of a decrease stage in accordance with a demand load and a decrease stage threshold; and decrease stage threshold modification means for modifying the decrease stage threshold in accordance with the output enable capacity of the capacity-degraded machine in a case where the capacity-degraded machine is detected.

* * * * *